US008707727B2

(12) United States Patent
Hastürk et al.

(10) Patent No.: US 8,707,727 B2
(45) Date of Patent: Apr. 29, 2014

(54) APPARATUS FOR COLLECTING LIQUIDS

(75) Inventors: Cemalettin Hastürk, Cerkezkoy/Tekirdag (TR); Laura Ringemann, Aliso Viejo, CA (US); Andrew Roberson, Long Beach, CA (US); Tolga Yegin, Izmir (TR)

(73) Assignee: BSH Home Appliances Corporation, Irvine, CA (US)

( * ) Notice: Subject to any disclaimer, the term of this patent is extended or adjusted under 35 U.S.C. 154(b) by 202 days.

(21) Appl. No.: 13/335,088

(22) Filed: Dec. 22, 2011

(65) Prior Publication Data

US 2013/0160481 A1 Jun. 27, 2013

(51) Int. Cl.
*F25D 3/00* (2006.01)
*B65D 1/34* (2006.01)

(52) U.S. Cl.
USPC ..... 62/391; 222/108; 222/111; 222/146.6; 62/389; 62/465

(58) Field of Classification Search
USPC ..... 62/389, 391; 220/571, 572; 222/108, 222/111, 146.6; 141/86; 137/312, 313
See application file for complete search history.

(56) References Cited

U.S. PATENT DOCUMENTS

2006/0065131 A1* 3/2006 Taylor ..... 99/446
2008/0174220 A1* 7/2008 Kim et al. ..... 312/405

* cited by examiner

*Primary Examiner* — Allen Flanigan
*Assistant Examiner* — Antonio R Febles
(74) *Attorney, Agent, or Firm* — James E. Howard; Andre Pallapies

(57) ABSTRACT

A dispensing unit includes a liquid collecting apparatus having a drip tray and a drip tray cover. The drip tray cover has an upper surface which comprises a plurality of troughs for collecting liquids. The tray includes an intermediate wall about which the drip tray cover pivots thereby allowing easy removal of the drip tray cover.

23 Claims, 6 Drawing Sheets

APPARATUS FOR COLLECTING LIQUIDS

FIELD OF THE INVENTION

The present technology relates to a dispensing unit (e.g., water, ice, etc.) for a refrigerator, including a liquid collecting apparatus.

BACKGROUND OF THE INVENTION

Known dispensing units often have liquid collecting apparatuses with covers that are difficult to remove.

What is needed is a dispensing unit with a liquid collecting apparatus having a cover that effectively passes liquids to the tray and is easy to remove from the tray.

SUMMARY OF THE INVENTION

One aspect of the technology relates to an apparatus for collecting liquids comprising a tray including a bottom wall and at least one outer sidewall defining a collection area. A cover member covers the collection area and includes a pressing area. At least one support member is disposed interior of the outer sidewall for supporting the cover member. A downward force against the cover member in the pressing area causes the cover member to move relative to (e.g., pivot about) the at least one support member such that a portion of the cover member is raised above the at least one outer sidewall to facilitate removal of the cover member.

One aspect of the technology relates to a dispensing unit that comprises at least one of an ice dispenser and a liquid dispenser. The dispensing unit further includes an apparatus for collecting liquids having a cover member designed to facilitate easy removal.

One aspect of the technology relates to a refrigerator having a dispensing unit for dispensing ice and/or a liquid and at least one compartment for storing items. The refrigerator further includes an apparatus for collecting liquids having a cover member designed to facilitate easy removal.

Other aspects, features, and advantages of this technology will become apparent from the following detailed description when taken in conjunction with the accompanying drawings, which are a part of this disclosure and which illustrate, by way of example, principles of this technology.

BRIEF DESCRIPTION OF THE DRAWINGS

The accompanying drawings facilitate an understanding of the various examples of this technology. In such drawings.

DETAILED DESCRIPTION OF ILLUSTRATED EMBODIMENTS

The following description is provided in relation to several examples which may share common characteristics and features. It is to be understood that one or more features of any one example may be combinable with one or more features of the other examples. In addition, any single feature or combination of features in any of the examples may constitute additional examples.

Figure 1:
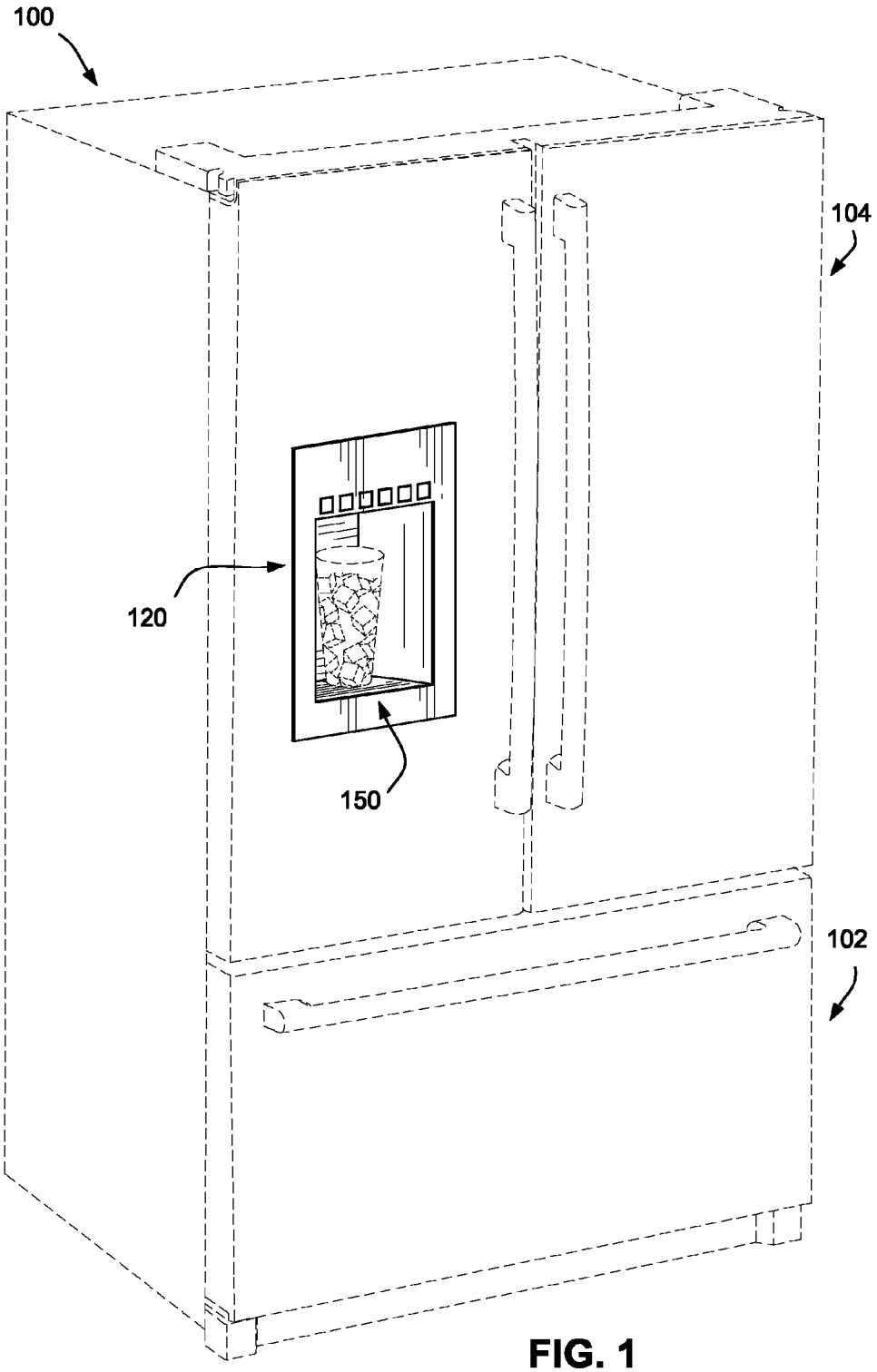
FIG. 1 is a three-dimensional representation of a refrigerator including a dispensing unit according to an example of the disclosed technology.

FIG. 1 shows a refrigerator 100 including a dispensing unit 120 according to an example of the disclosed technology. The refrigerator includes a plurality of compartments (e.g., a freezer compartment 102 and a cold compartment 104) for storing items.

Figure 7:
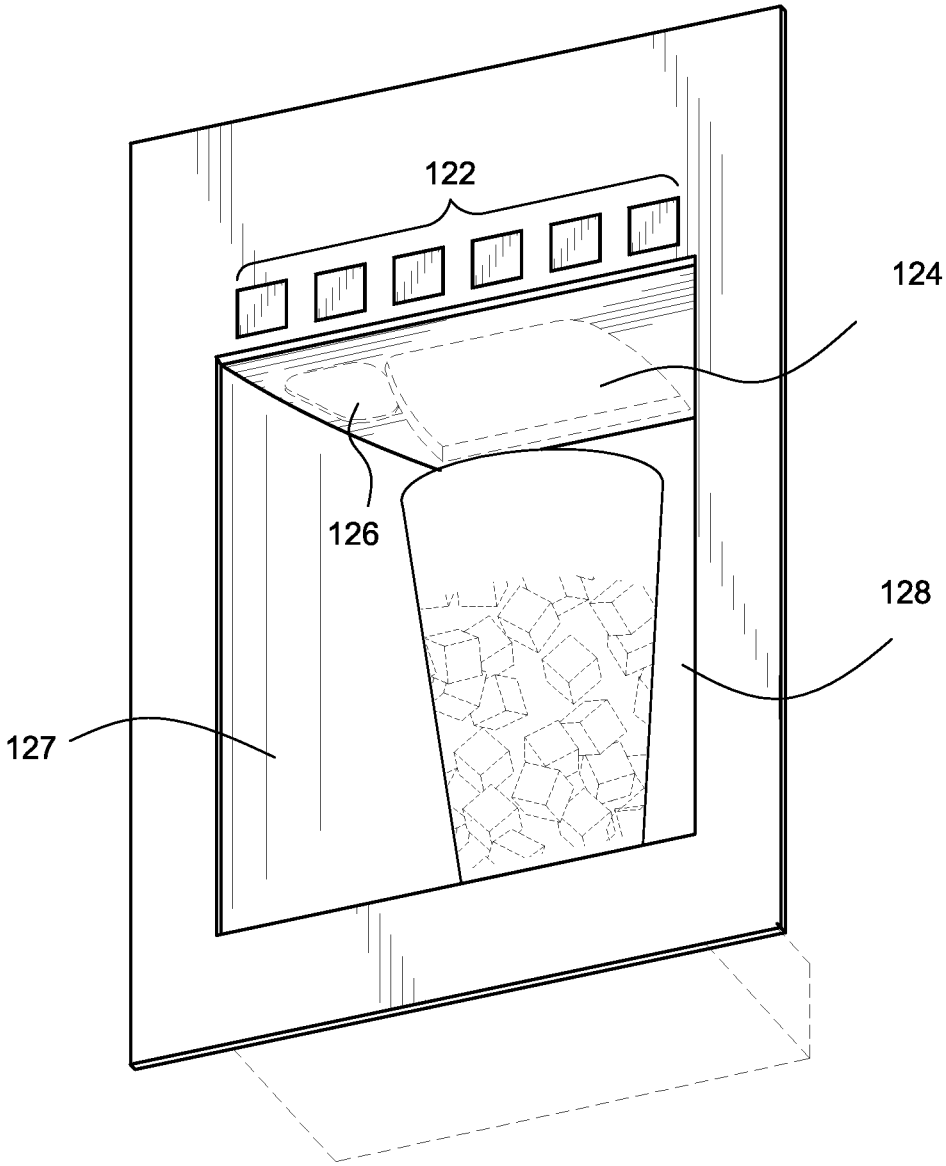
FIG. 7 is a perspective view of the dispensing unit of FIG. 1.

As shown in FIG. 7, the dispensing unit includes an ice dispenser 124, a liquid dispenser 126 (e.g., water), and a plurality of actuators 122 (e.g., buttons) for controlling the ice dispenser 124 and the liquid dispenser 126. The dispensing unit 120 also includes a liquid collecting apparatus 150. The dispensing unit 120 forms a recessed portion in the refrigerator including a pair of sidewalls 127 and a rear wall 128.

Figure 2A:
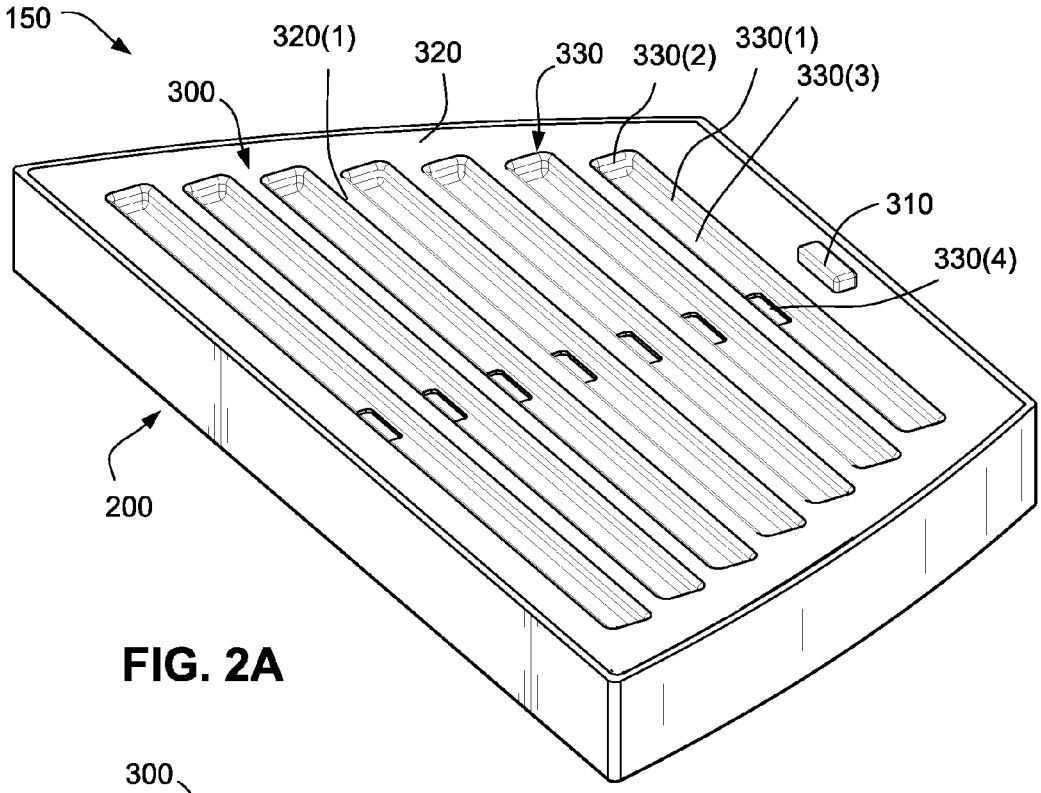
FIG. 2A is a perspective view of a liquid collecting apparatus of the dispensing unit of FIG. 1.

Referring to FIG. 2A, the liquid collecting apparatus 150 includes a drip tray 200 and a drip tray cover 300. The drip tray cover 300 may be made of metal, for example, or any other suitable material. The drip tray 200 is formed of injection molded plastic, but could be made of another suitable material.

The drip tray cover 300 has an upper surface 320 which comprises a plurality of troughs 330. The troughs are configured to collect liquids which may contact the drip tray cover. For example, stray ice cubes or water dispensed from the dispensing unit 120 may fall onto the drip tray cover.

Each trough 330 has a pair of side walls 330(1), a pair of end walls 330(2), and a bottom surface 330(3). However, the trough 330 could have a different configuration (e.g., a pair of angled sidewalls and a single end wall). A hole 330(4) is disposed in the bottom surface 330(3) to allow liquids to pass from the trough into the tray 200. The side walls 330(1), the end walls 330(2) and the bottom surface 330(3) may be angled to force liquids toward the hole 330(4). The hole 330(4) could also have a funnel shape or any other shape that may cause liquids to more easily flow towards and pass through the hole 330(4).

In addition to the troughs 330, the upper surface 320 also has a plurality of intermediate portions 320(1) interspersed with the troughs 330. In the illustrated example, the intermediate portions 320(1) are disposed between adjacent troughs. However any suitable configuration may be employed. The upper surface further includes a tab 310 to aid a user in grasping or moving the drip tray cover.

Figure 3:
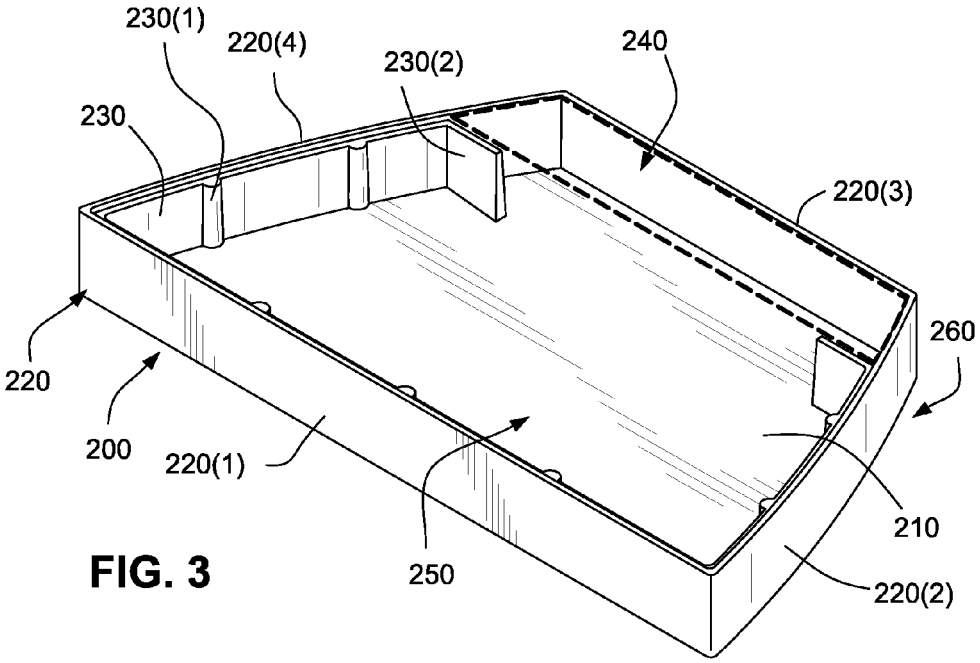
FIG. 3 is a perspective view of the drip tray of the liquid collecting apparatus of FIG. 2A.
Figure 4:
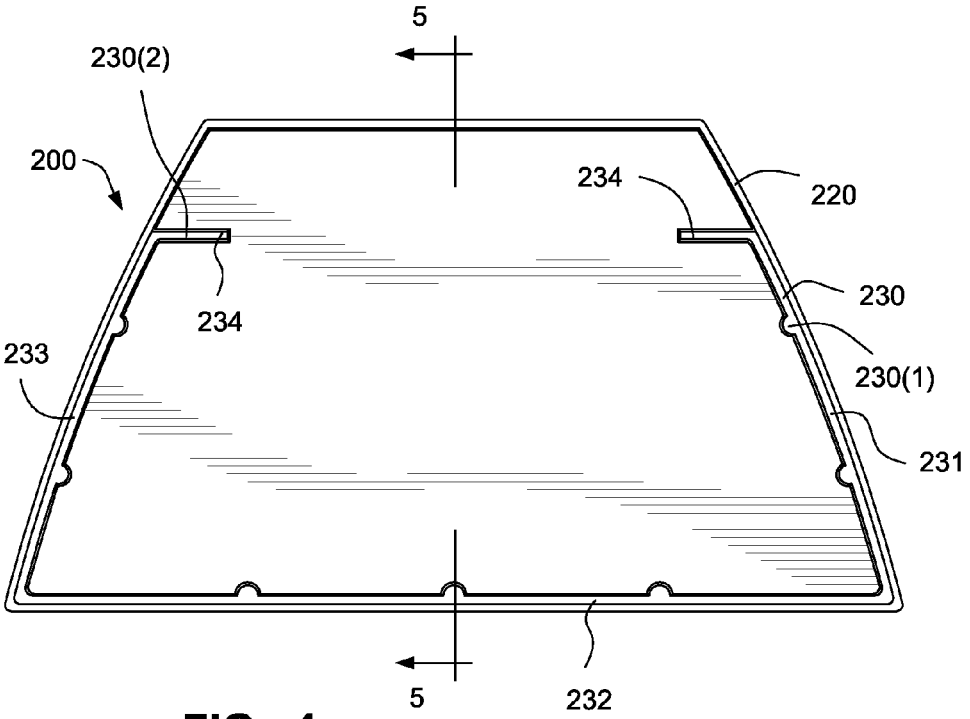
FIG. 4 is a top view of the drip tray of the liquid collecting apparatus of FIG. 2A.
Figure 5:
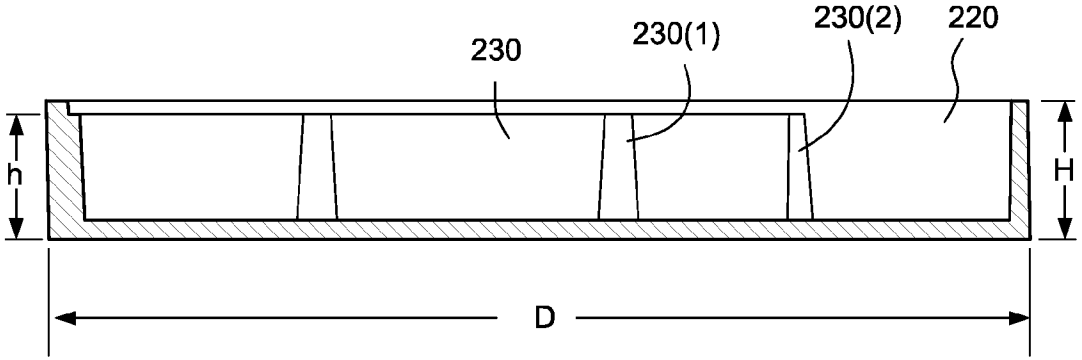
FIG. 5 is a cross-sectional view along line 5-5 of FIG. 4.

Referring to FIGS. 3-5, the drip tray 200 includes a bottom 210, an outer surrounding wall 220, and an inner support wall 230 defining a collection area 250. Liquids that pass through the holes 330(4) are collected in the collection area 250. The outer surrounding wall 220 is formed of a plurality of sidewalls 220(1), 220(2), 220(3), 220(4). In the illustrated example, the outer surrounding wall 220 has four sidewalls forming a generally trapezoidal shape; however one skilled in the art will appreciate that the outer surrounding wall could have a different number of sidewalls and could have a different shape (e.g., rectangular, square, semi-circle).

The inner support wall 230 is situated adjacent the outer surrounding wall 220 and functions to support the drip tray cover 300. In the illustrated example, the inner support wall 230 abuts against the outer surrounding wall. The inner support wall 230 is formed of a plurality of sidewalls 231, 232, 233, 234. In the illustrated example, the inner support wall has four sidewalls, with the sidewall 234 being a partial wall (e.g., forming an interrupted structure along the bottom wall 210). It is noted that any number of the sidewalls may be partial walls. Further, the inner support wall 230 may include more or less than the four illustrated sidewalls 231, 232, 233, 234. Moreover, one skilled in the art will understand that the sidewalls need not be connected to one another. The inner support wall 230 may also include protruding supports 230(1) to aid in supporting the drip tray cover 300. The illustrated protruding supports 230(1) have a semi-circle configuration projecting from the inner support wall 230 thereby providing additional surface area for the drip tray cover 300 to rest. The protruding supports 230(1) may have other shapes (e.g., square, rectangular, triangular, etc.)

A pivoting support 230(2) is disposed in the collection area 250. In the illustrated example, the sidewall 234 forms the pivoting support 230(2). However, it is noted that the pivoting support may be constructed so as not to form part of the inner support wall 230. As will be described later, the pivoting support 230(2) forms a fulcrum about which the drip tray cover 300 pivots.

As shown in FIG. 5, the inner support wall 230 has a height h that is less than a height H of the outer surrounding wall, and the drip tray cover 300 is sized to fit within the outer surrounding wall 220. Therefore, the trip tray cover 300 is supported by the inner support wall 230 and positioned within the outer surrounding wall 220. The thickness of the drip tray cover 300 is substantially the same as the difference between the height H and the height h. As such, the drip tray cover 300 essentially lies flush in the drip tray 200. In another example, the drip tray cover 300 may lie recessed in the drip tray 200. The flush or recessed mounting arrangement allows for smooth removal of a container, but it may be difficult for a user to grasp the drip tray cover when it is desired to remove the drip tray cover from the dispensing unit 120.

The pivoting support 230(2) divides the collection area 250 to form an action area at one end portion of the drip tray 200, e.g., toward the rear. The drip tray cover 300 is not supported by the inner support wall 230 in the action area, i.e., a portion of the drip tray cover 300 is cantilevered or unsupported. The action area 240 is indicated by the dotted line in FIGS. 3 and 6. As will be described later, a downward force applied to the drip tray cover 300 in the action area 240 will cause the drip tray cover to move relative to or pivot about the pivoting support 230(2) to facilitate removal of the drip tray cover. In another variant, downward force could cause a spring-loaded member to prop up the cover so the user could easily grasp a part of the cover 300.

Figure 2B:
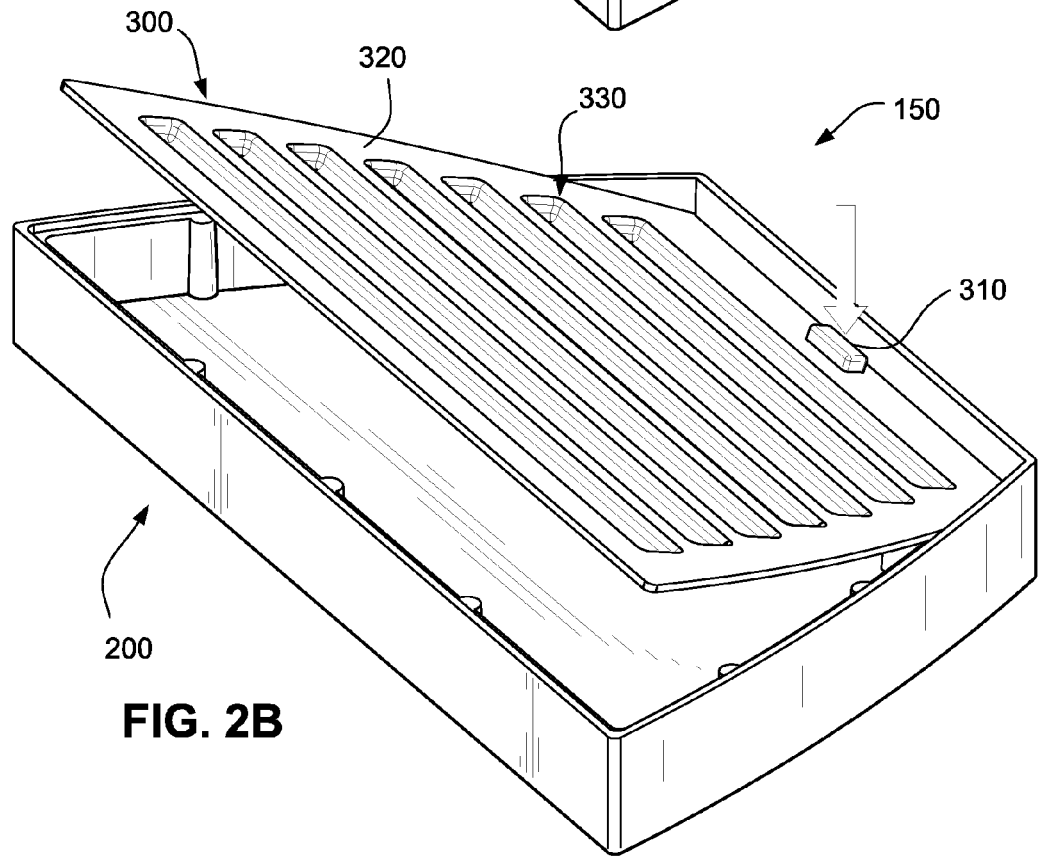
FIG. 2B is a perspective view of the liquid collecting apparatus of FIG. 2A showing a force applied against the pressing area of the drip tray cover.
Figure 6A:
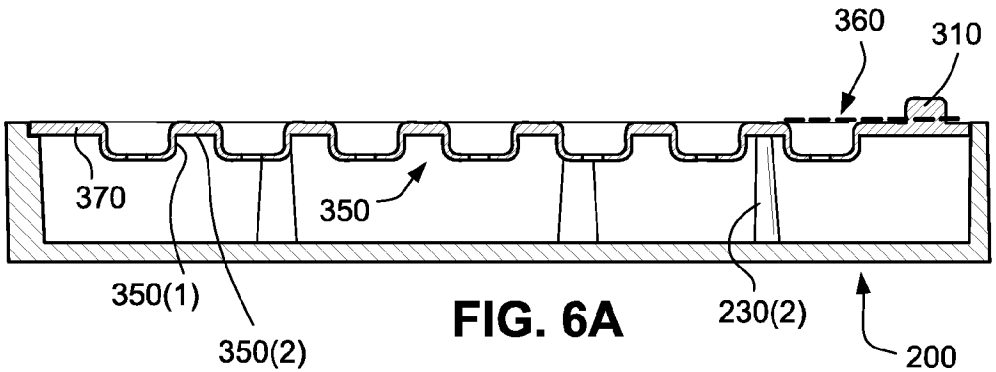
FIG. 6A is a side cross-sectional view of the liquid collecting apparatus of FIG. 2A.

Referring to FIGS. 2B and 6A, drip tray cover 300 includes a bottom 370 having a plurality of grooves 350. Each groove has a pair of sidewalls 350(1) and a pivoting surface 350(2). At least one groove is situated to accommodate the pivoting support 230(2). The groove which accommodates the pivoting support may serve to quickly orient the drip tray cover when a user replaces the drip tray cover. In other words, the groove is located such that the drip tray cover will easily fall into place when inserted into the drip tray 200.

Figure 6B:
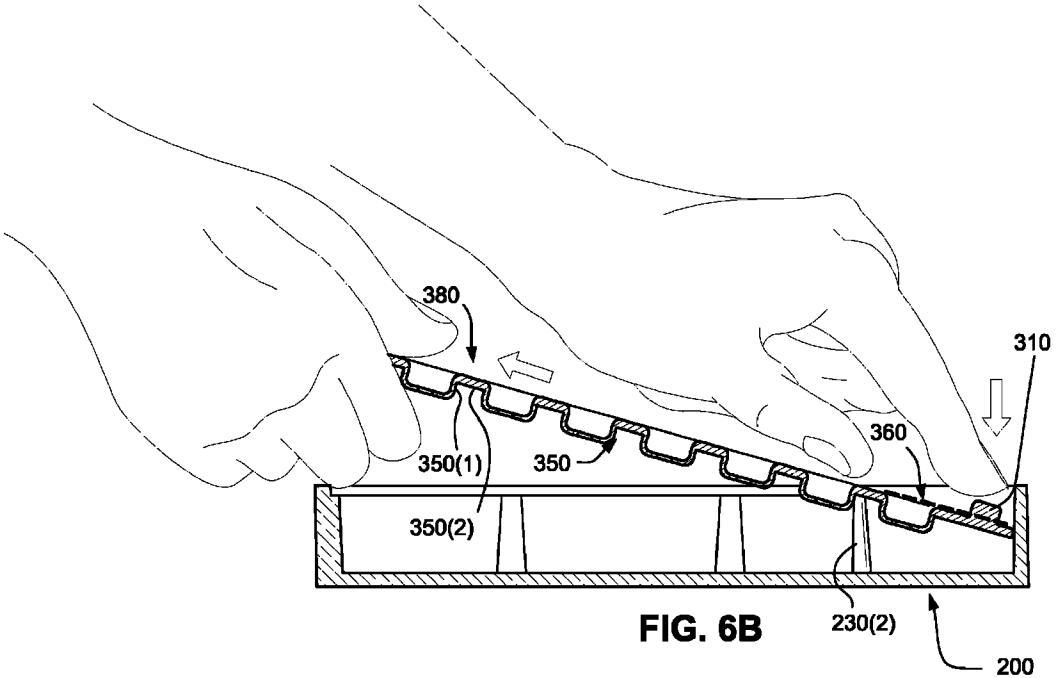
FIG. 6B is a side cross-sectional view of the liquid collecting apparatus of FIG. 2A showing removal of the drip tray cover.

The drip tray cover includes a pressing area 360 which corresponds to the action area 240 of the drip tray 200. The pressing area 360 is indicated by the dotted line in FIGS. 6A and 6B. The tab 310 may be positioned to further serve as a visual clue of the pressing area 360. The drip tray cover 300 could also have other visual clues (printed words or colors, etc.). Since the drip tray cover 300 is not supported by the inner support wall 230 in the action area 240, downward force in the pressing area 360 of the drip tray cover 300 will cause the drip tray cover to move relative to or pivot on the pivoting support 230(2). As a result, the front portion 380 of the drip tray cover 300 is raised from its mounting, thereby allowing the user to easily grasp the drip tray cover for removal, as shown in FIG. 6B. In the illustrated example, the user presses down on the drip tray cover 300 in the pressing area 360 with one hand and grasps the front portion 380 of the cover 300 with the other hand. However, the removal action could be performed with a single hand.

The pivoting support 230(2) is positioned in the collection area 250 toward a rear portion 260 of the drip tray 200. The pivoting support 230(2) is positioned such that the center of gravity of a container (e.g., cup) placed on the drip tray cover will be positioned forward of the fulcrum 230(2) so as to not cause the drip tray cover to pivot on the pivoting support 230(2). For example, the fulcrum is positioned more than about half, preferably 70-90% the depth D of the drip tray 200. However, even if a container causes the drip tray cover to pivot thereby tipping the container, the sidewalls 127 and/or the rear wall 128 can be arranged to support a tipped container and prevent the container from tipping completely.

While the technology has been described in connection with what are presently considered to be the most practical and preferred examples, it is to be understood that the technology is not to be limited to the disclosed examples, but on the contrary, is intended to cover various modifications and equivalent arrangements included within the spirit and scope of the disclosure.

What is claimed is:

1. An apparatus for collecting liquids, comprising:

a tray including a bottom wall and at least one outer sidewall defining a collection area;

a cover member for covering the collection area, the cover member including a pressing area; and at least one support member interior of the outer sidewall for supporting the cover member, the at least one support member forming a partial wall structure which extends in an interrupted manner along the bottom wall, wherein a downward force against the cover member in the pressing area causes the cover member to move relative to the at least one support member such that a portion of the cover member is raised above the at least one outer sidewall to facilitate removal of the cover member.

2. The apparatus according to claim 1, further comprising an inner support wall adjacent the outer sidewall for supporting the cover member.

3. The apparatus according to claim 2, wherein the inner support wall includes four sidewalls.

4. The apparatus according to claim 2, wherein the inner support wall includes at least one protruding support projecting therefrom to aid in supporting the cover member.

5. The apparatus according to claim 2, wherein the at least one support member is part of the inner support wall.

6. The apparatus according to claim 1, wherein the cover member has a bottom including a groove which accommodates the at least one support member.

7. The apparatus according to claim 1, wherein the pressing area is located towards a rear portion of the cover member such that a front portion of the cover member is raised above the at least one outer sidewall.

8. The apparatus according to claim 1, wherein the cover member pivots about the at least one support member.

9. A dispensing unit, comprising:

at least one of an ice dispenser and a liquid dispenser; and the apparatus according to claim 1.

10. A refrigerator, comprising:

a dispensing unit for dispensing ice and/or a liquid;

at least one compartment for storing items; and the apparatus according to claim 1.

11. An apparatus for collecting liquids, comprising:

a tray including a bottom wall and at least one outer sidewall defining a collection area to collect liquids;

a cover member for covering the collection area, the cover member including a pressing area; and at least one support member interior of the outer sidewall for supporting the cover member, the at least one support member dividing the collection area to form an action area therewithin, the action area corresponding to the pressing area of the cover member, wherein a downward force against the cover member in the pressing area causes the cover member to move relative to the at least one support member such that a portion of the cover member is raised above the at least one outer sidewall to facilitate removal of the cover member, and wherein the action area is open to an adjacent portion of the collection area such that the liquids are permitted to flow between the action area and the adjacent portion of the collection area.

12. The apparatus according to claim 11, further comprising an inner support wall adjacent the outer sidewall for supporting the cover member.

13. The apparatus according to claim 12, wherein the inner support wall includes four sidewalls.

14. The apparatus according to claim 12, wherein the inner support wall includes at least one protruding support projecting therefrom to aid in supporting the cover member.

15. The apparatus according to claim 12, wherein the at least one support member is part of the inner support wall.

16. The apparatus according to claim 11, wherein the cover member has a bottom including a groove which accommodates the at least one support member.

17. The apparatus according to claim 11, wherein the pressing area is located towards a rear portion of the cover member such that a front portion of the cover member is raised above the at least one outer sidewall.

18. The apparatus according to claim 11, wherein the cover member pivots about the at least one support member.

19. The apparatus according to claim 11, wherein the liquids are permitted to flow along the bottom wall between the action area and the adjacent portion of the collection area.

20. A dispensing unit, comprising:

at least one of an ice dispenser and a liquid dispenser; and the apparatus according to claim 11.

21. A refrigerator, comprising:

a dispensing unit for dispensing ice and/or a liquid;

at least one compartment for storing items; and the apparatus according to claim 11.

22. An apparatus for collecting liquids, comprising:

a tray including a bottom wall and at least one outer sidewall defining a collection area to collect liquids, the outer sidewall including a first sidewall, a second sidewall, a third sidewall and a fourth sidewall;

a cover member for covering the collection area, the cover member including a pressing area;

at least one support member interior of the outer sidewall for supporting the cover member, wherein a downward force against the cover member in the pressing area causes the cover member to move relative to the at least one support member such that a portion of the cover member is raised above the at least one outer sidewall to facilitate removal of the cover member, wherein the first sidewall and the second sidewall are arranged to oppose one another, and the third sidewall and the fourth sidewall are arranged to opposed one another, wherein the first sidewall has a length longer than a length of the second sidewall such that the first side wall forms a relatively wide side of the tray and the second sidewall forms a relatively narrow side of the tray, and wherein the pressing area of the cover member is arranged on the relatively narrow side of the tray.

23. The apparatus according to claim 22, wherein the pressing area has a tab protruding therefrom to indicate a target location for applying the downward force.

* * * * *